US011814269B2

(12) United States Patent
Jackson et al.

(10) Patent No.: US 11,814,269 B2
(45) Date of Patent: Nov. 14, 2023

(54) COUNTERWEIGHT SYSTEM FOR LIFTING MACHINES

(71) Applicant: Caterpillar Inc., Peoria, IL (US)

(72) Inventors: Robert A. Jackson, Edwards, IL (US); Benjamin Barbier, Grenoble (FR); Curtis J. Caldwell, Metamora, IL (US); Michael T. Jackson, Hanna City, IL (US)

(73) Assignee: Caterpillar Inc., Peoria, IL (US)

( * ) Notice: Subject to any disclaimer, the term of this patent is extended or adjusted under 35 U.S.C. 154(b) by 71 days.

(21) Appl. No.: 17/218,241

(22) Filed: Mar. 31, 2021

(65) Prior Publication Data

US 2022/0315394 A1 Oct. 6, 2022

(51) Int. Cl.
*B66C 23/76* (2006.01)
*B66C 23/44* (2006.01)

(52) U.S. Cl.
CPC ..... *B66C 23/76* (2013.01); *B66C 23/44* (2013.01); *B66C 2700/0357* (2013.01); *B66C 2700/0392* (2013.01)

(58) Field of Classification Search
CPC ..... B66C 23/44; B66C 23/72; B66C 23/74; B66C 23/76; B66C 2700/0357; B66C 2700/0392; E02F 9/10; B62D 49/085
See application file for complete search history.

(56) References Cited

U.S. PATENT DOCUMENTS

| | | | | |
|---|---|---|---|---|
| 3,236,391 | A * | 2/1966 | Kennedy | B66C 23/76 212/196 |
| 3,378,148 | A * | 4/1968 | Stanley | B66C 23/76 212/196 |
| 4,083,459 | A * | 4/1978 | Allen | B66C 23/76 212/196 |
| 5,518,128 | A * | 5/1996 | Kroll | B66C 23/76 212/196 |
| 6,609,622 | B2 | 8/2003 | Forsyth | |
| 7,669,724 | B2 | 3/2010 | Styck et al. | |
| 8,783,477 | B2 | 7/2014 | Camacho et al. | |
| 9,278,834 | B2 | 3/2016 | Pech et al. | |
| 10,773,931 | B2 | 9/2020 | Pletz et al. | |

FOREIGN PATENT DOCUMENTS

DE 102019110822 A1 10/2020

OTHER PUBLICATIONS

DE 2019/110822A1 Machine Translation (Year: 2019).*

* cited by examiner

*Primary Examiner* — Michael R Mansen
*Assistant Examiner* — Juan J Campos, Jr.
(74) *Attorney, Agent, or Firm* — Bookoff McAndrews, PLLC

(57) ABSTRACT

A mobile pipelayer machine includes a machine chassis having a forward end, a rear end, a first side, and a second side, and a boom extending from the first side of the machine chassis. The mobile pipelayer machine also includes a movable counterweight system extending from the second side of the machine chassis, the movable counterweight system being selectively movable to change a center of gravity of the machine in at least one of a forward or a rearward direction.

20 Claims, 5 Drawing Sheets

COUNTERWEIGHT SYSTEM FOR LIFTING MACHINES

TECHNICAL FIELD

The present disclosure relates generally to lifting machines, and more particularly to counterweight systems for such machines.

BACKGROUND

Lifting machines, such as pipelayer machines are used for lifting and moving large objects into or above the ground. Such objects can include heavy lengths of conduit for pipelines. The installation of such conduits can be challenging. The desired locations of such pipelines can be some of the most remote areas on earth, and the terrain over which the pipeline must traverse is often some of the most rugged. The land may have significant elevational changes and varying types of ground. In order to install the conduit, the pipelayer machine must be able to traverse such terrain and be able to lift and accurately place loads often in excess of 200,000 pounds.

When installing the conduit, the pipelayer machine uses a boom on the side of the machine that can be controllably extended away from the machine over a range of angles with respect to the chassis of the machine. One or more cables may extend from a winch or other power source through a series of sheaves or pulleys and terminate in a grapple hook or other suitable terminus of the boom. The grapple hook can then be secured to the pipe in such a way that when the winch recoils, the pipe is lifted. The pipelayer machine is then navigated to a desired location and the boom is lowered to a desired location for accurate installation of the pipe, such as into a trench.

During operation, the pipelayer machine positions the weight of the conduit in cantilevered fashion away from the chassis, engine and undercarriage of the pipelayer. As the chassis, engine and undercarriage comprise the majority of the weight of a pipelayer, depending on the weight of the pipe being lifted and the length of the boom arm, the pipelayer can be subject to potential tipping and instability. This potential tipping in the roll direction can be offset by extending a counterweight assembly away from the pipelayer machine on a side of the machine opposite the boom. However, such counterweight assemblies do not address potential tipping in a fore-aft (forward or rearward) direction.

Current demands being placed on pipelayer machines require higher lifting capacities and boom lengths/angles. The pipelayer could in theory simply be made larger and heavier to satisfy these needs, but realistically the general footprint of the pipelayer is limited by cost, maneuverability, and transportation considerations. As stated above, pipelayers need to be operated in very remote and difficult locations. Pipelayer machines also have to be nimble enough to perform the job. Moreover, over-sizing the undercarriage and boom of the pipelayer will also increase manufacturing costs in terms of materials, and operating costs in terms of fuel.

U.S. Pat. No. 8,783,477 B2 to Camacho et. al. ("the '477 patent") discloses a counterweight system for a pipelayer machine. The counterweight system of the '477 patent provides additional lifting capacity by selectively deploying the counterweight system away from the undercarriage once the boom is extended past a predetermined distance. Thus, the counterweight system addresses tipping of the pipelayer in a roll (side-to-side) direction.

The counterweight system of the present disclosure may solve one or more of the problems set forth above and/or other problems in the art. The scope of the current disclosure, however, is defined by the attached claims, and not by the ability to solve any specific problem.

SUMMARY

In accordance with one aspect of the present disclosure, a mobile pipelayer machine includes a machine chassis having a forward end, a rear end, a first side, and a second side, and a boom extending from the first side of the machine chassis. The mobile pipelayer machine also includes a movable counterweight system extending from the second side of the machine chassis, the movable counterweight system being selectively movable to change a center of gravity of the machine in at least one of a forward or a rearward direction.

In accordance with another aspect of the present disclosure, a mobile pipelayer machine includes a machine chassis having a forward end, a rear end, a first side, and the second side, and a boom extending from the first side of the machine chassis. The mobile pipelayer machine also includes a movable counterweight system extending from a second side of the machine chassis, the movable counterweight system being selectively movable forwardly, rearwardly, and laterally towards and away from the second side of the machine chassis to change a center of gravity of the machine in a forward, rearward, and roll direction.

In accordance with yet another aspect of the present disclosure, a method for adjusting a center of gravity of a pipelayer machine is provided. The pipelayer machine includes a chassis, a boom extending from the chassis, and a connector extending from the boom for coupling to a load. The method includes selectively moving a counterweight assembly in a forward or rearward direction to change a forward or a rearward center of gravity of the pipelayer machine.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," substantially," and "approximately" are used to indicate a possible variation of ±10% in the stated value.

Figure 1:
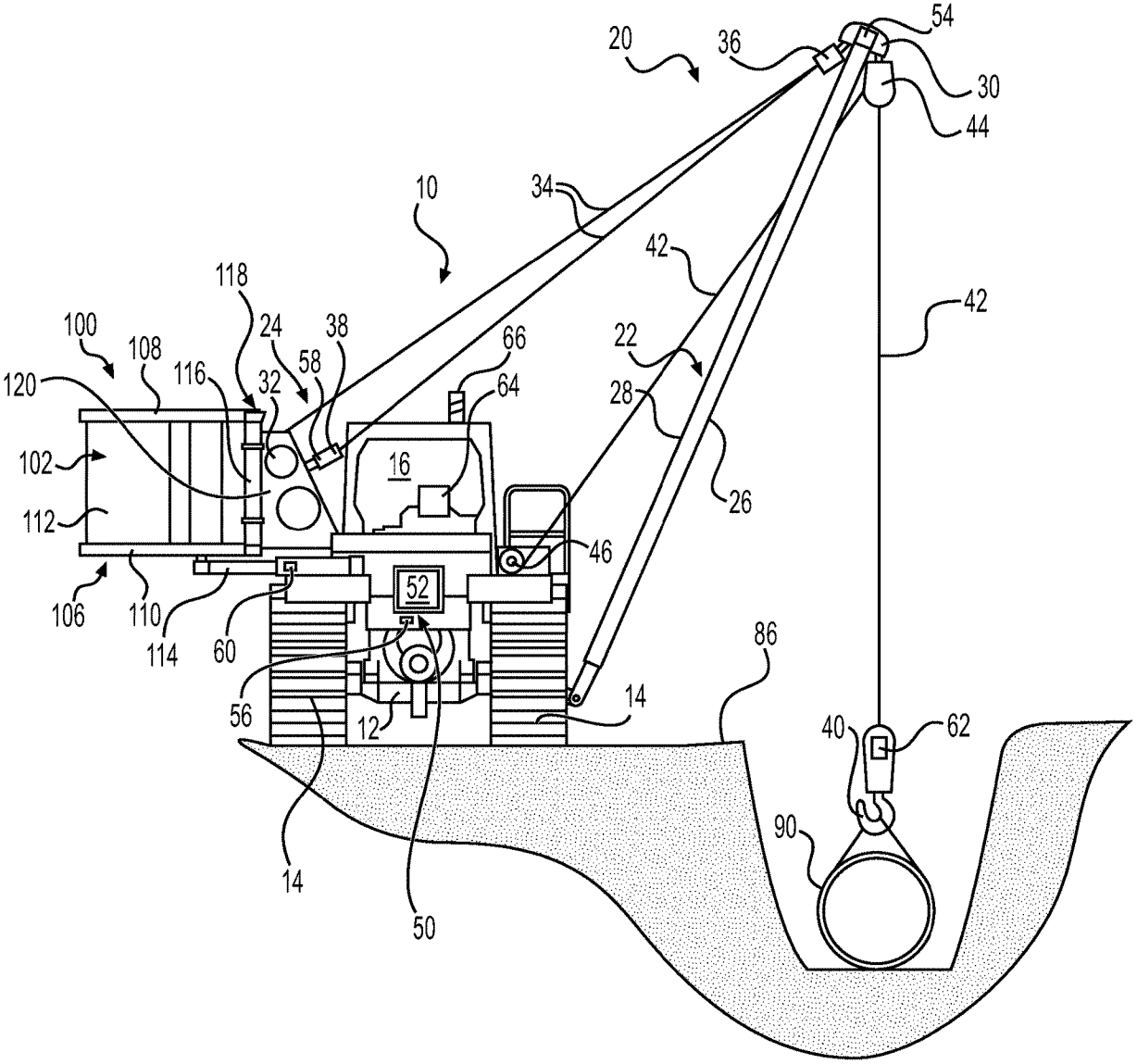
FIG. 1 shows a front view of an exemplary lifting machine having a crane assembly and counterweight assemblies in accordance with the present disclosure.

FIG. 1 illustrates a mobile lifting machine 10 having a crane assembly 20. Throughout this disclosure, lifting machine 10 will be described with reference to a mobile pipelayer machine, however it is understood that lifting machine 10 may be any type of lifting machine having a crane assembly 20. Pipelayer machine 10 may include a forward or front end, a rear or back end, a chassis 12, a pair of drive tracks 14, a movable counterweight system 100, a power source such as an internal combustion engine (not shown), and an operator's cab 16. As will be described in more detail below, pipelayer machine 10 may also include a control system 50 including a controller 52 coupled to a plurality of sensors 54-62, an indicator 66, and a display 64 located in the operator's cab 16.

Figure 2:
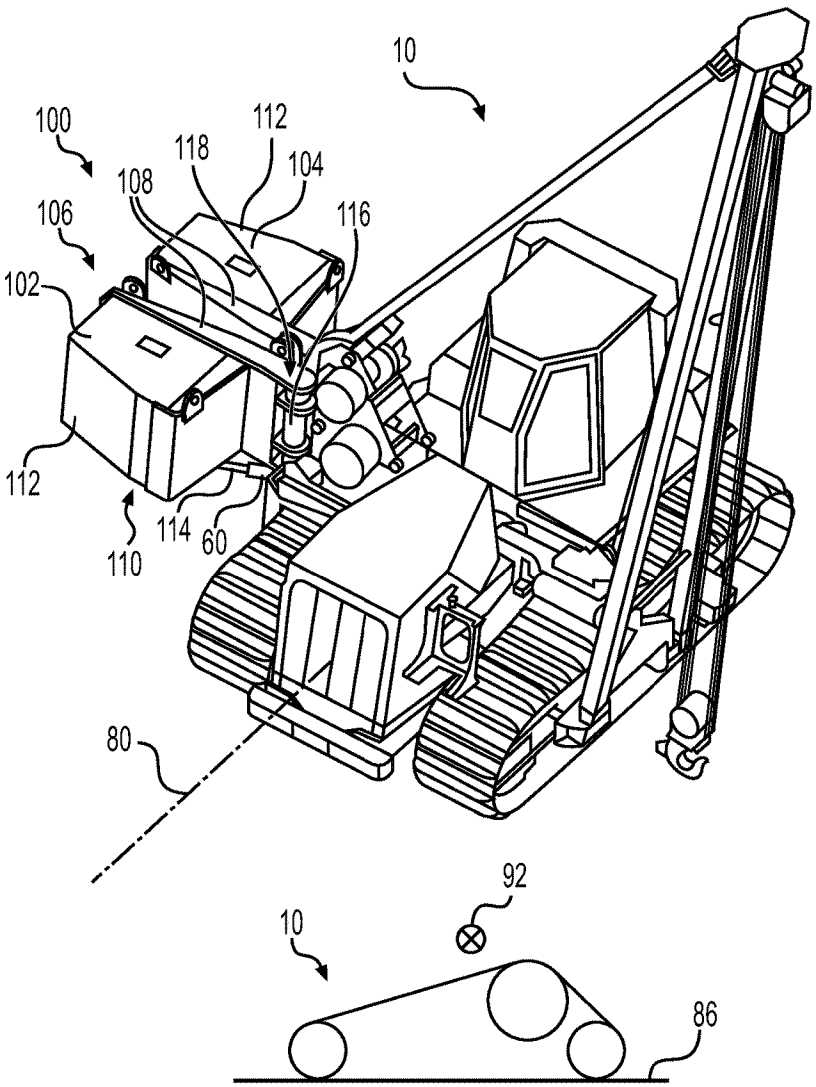

As shown in FIGS. 1 and 2, crane assembly 20 may centrally located on a side of pipelayer machine 10, and may include a boom 22, and a winch system 24. The boom 22 may include first and second arms 26, 28 (only one arm shown in FIG. 1) independently hinged to the chassis 12 at one end, and extending to a joined boom tip 30. Winch system 24 may include winch 32 and a first set of lifting cables 34 extending from winch 32 through a series of pulleys or sheaves 36, 38. The crane assembly 20 may further include a grapple hook 40 or other terminating connector coupled to the boom tip 30 through a second set of lifting cables 42, pulleys or sheaves 44, 46, and winch 32. While a winch system 24 is described above, it is understood that other systems may be employed to control aspects of the crane assembly 20, such a hydraulic actuator system (not shown) controlling movement of the boom 22.

Counterweight system 100 may include a one or more moving counterweight assemblies, such as a pair of moving counterweight assemblies 102, 104 (FIG. 2). Each counterweight assembly 102, 104 may be generally the same configuration, and thus reference below to a particular feature of counterweight assembly 102 is equally applicable to counterweight assembly 104, and visa-versa. The counterweight assemblies 102, 104 are selectively movable between a fully retracted or stowed position adjacent the chassis 12 and vertically over the drive track 14 (FIG. 5), and a fully extended position laterally distanced from the chassis 12 and drive track 14 (FIG. 2). In the stowed position, the counterweight assemblies are generally parallel to a longitudinal axis 80 of the pipelayer machine 10, and in the fully extended position, the counterweight assemblies extend generally perpendicular to the longitudinal axis 80 of the machine. Thus, each of the counterweight assemblies 102, 104 are movable about an arc of approximately 90 degrees, thereby moving the counterweight assemblies in a forward or rearward direction (i.e., the direction of travel) and toward and away from the chassis 12 of the pipelayer machine 10.

Counterweight assemblies 102, 104 may take any appropriate configuration to provide for movement of each assembly in a forward or rearward direction, and in a lateral direction towards and away from the machine chassis 12. For example, with reference to counterweight assembly 102 shown in FIGS. 1 and 2-5, counterweight assemblies 102, 104 may having a movable shelf 106 including an arm or spine 108 and a lower platform 110 for receiving one or more weights 112. The counterweight assemblies 102, 104 may also include an actuator 114 for controllably moving the shelf 106 between the stowed and fully extend positions.

The arm or spine 108 of movable shelf 106 may be generally planar and extend vertically between a top of weights 112 and lower platform 110. Arm 108 may include a hinge coupling 116 adjacent chassis 12 to form a hinge connection 118 with a mating hinge coupling 120 coupled to chassis 12 at a side of pipelayer machine 10. With this connection, movable shelf 106 is cantilevered from the chassis 12 of pipelayer machine 10. Lower platform 110 may be generally planar, extend horizontally from arm 108, and may be rigidly coupled to arm 108. Lower platform 110 is sized to receive one or more weights 112, such as a plurality of horizontally extending stacked plates.

Figure 5:
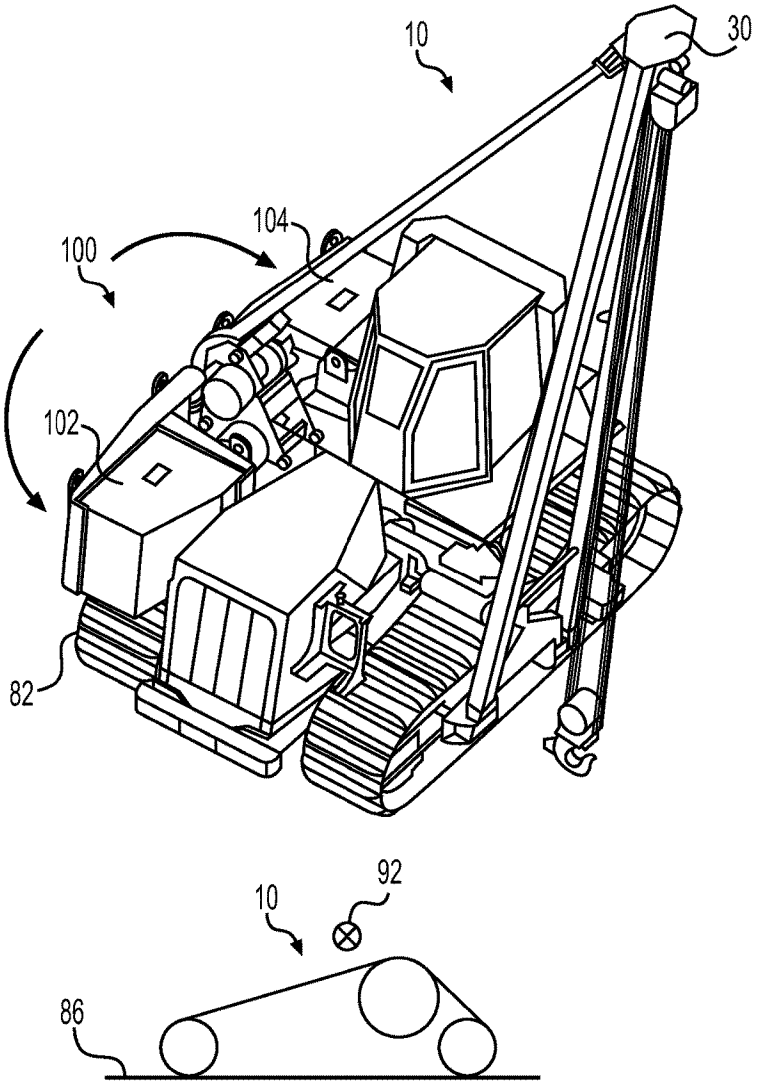

Actuator 114 of each counterweight assembly 102, 104 may be coupled to the movable shelf 106 and the chassis 12 of pipelayer machine 10, such that actuation of actuator 114 selectively moves movable shelf 106 about a horizontal plane to any position from the fully extended position to the fully retracted or stowed positions (e.g. FIGS. 2 and 5). Actuator 114 may be, for example, a hydraulic actuator assembly receiving counterweight position commands 68 from controller 52 (FIG. 6), as will be explained in more detail below. As shown best in FIG. 1, actuator 114 may be pivotally coupled to an underside of lower platform 110 and to the chassis 12 above track 14, so that extension of the actuator 114 moves the movable shelf 106 toward the extend position, and retraction of the actuator 114 moves the movable shelf 106 toward the retracted or stowed position. It is understood that the actuator could take other forms (e.g., motor driven actuator), and could be coupled in any other appropriate location to move a counterweight assembly 102, 104. Counterweight assembly 102 can be moved independently of counterweight assembly 104, and vice versa. As used herein, reference to coupling to the chassis 12 may include direct or indirect couplings.

As noted above, counterweight system may take alternative forms from that shown in the figures. For example, the counterweight system 100 may include only one counterweight assembly 102 that is pivotable about the 90 degree arc discussed above, or pivotable about a 180 degree arc from a fully retracted forward position, through a fully extended position, and to a fully retracted rearward position. Alternatively counterweight system 100 may include a counterweight assembly that includes a horizontal type pivot or four-bar connection so that the counterweight assembly can be moved up and down to extend the counterweight assembly toward and away from the chassis 12. In such a counterweight assembly the weights may be moved linearly forwardly or rearwardly to change the fore-aft center of gravity by selectively moving a weight-supporting lower shelf forwardly or rearwardly. Alternatively, such a system could be separated into independently and selectively movable forward and rearward counterweight assemblies. In yet another arrangement, one or more counterweights may be moveable along a linear rail to permit adjustment from front to rear to adjust the fore-aft center of gravity.

As will be discussed in more detail below, FIGS. 2-5 show examples of the counterweight assemblies 102, 104 in various positions as a function of the machine pitch and roll, and load on the boom 22 of crane assembly 20. As shown in FIG. 2, when both of the counterweight assemblies 102, 104 are in their fully extended positions, their respective arms 108 are adjacent, extend generally normal to the chassis 12, and face one another. As shown in FIG. 5, when the counterweight assemblies 102, 104 are both in their fully retracted or stowed positions their respective arms 108 are generally parallel to one another. Also, counterweight assemblies are each connected to chassis 12 at a generally central longitudinal position of pipelayer machine 10, and generally longitudinally aligned with the crane assembly 20 (e.g., boom tip 30). As shown in FIG. 5, when the counterweigh assemblies 102, 104 are in their fully retracted or stowed positions, the counterweight assemblies 102, 104 do not extend longitudinally beyond the front or rear end of the pipelayer machine 10, and, for example, extend longitudinally approximately the entire length of pipelayer machine 10. Also, in the fully retracted positions, counterweight assemblies 102, 104 are tucked over the track 14 so as to extend over the majority of track 14, and approximately to a lateral extent 82 of the track 14. Thus, the counterweight assemblies 102, 104 include a stowed position that generally does not increase the length or width (or height) profile of pipelayer machine 10.

Figure 6:
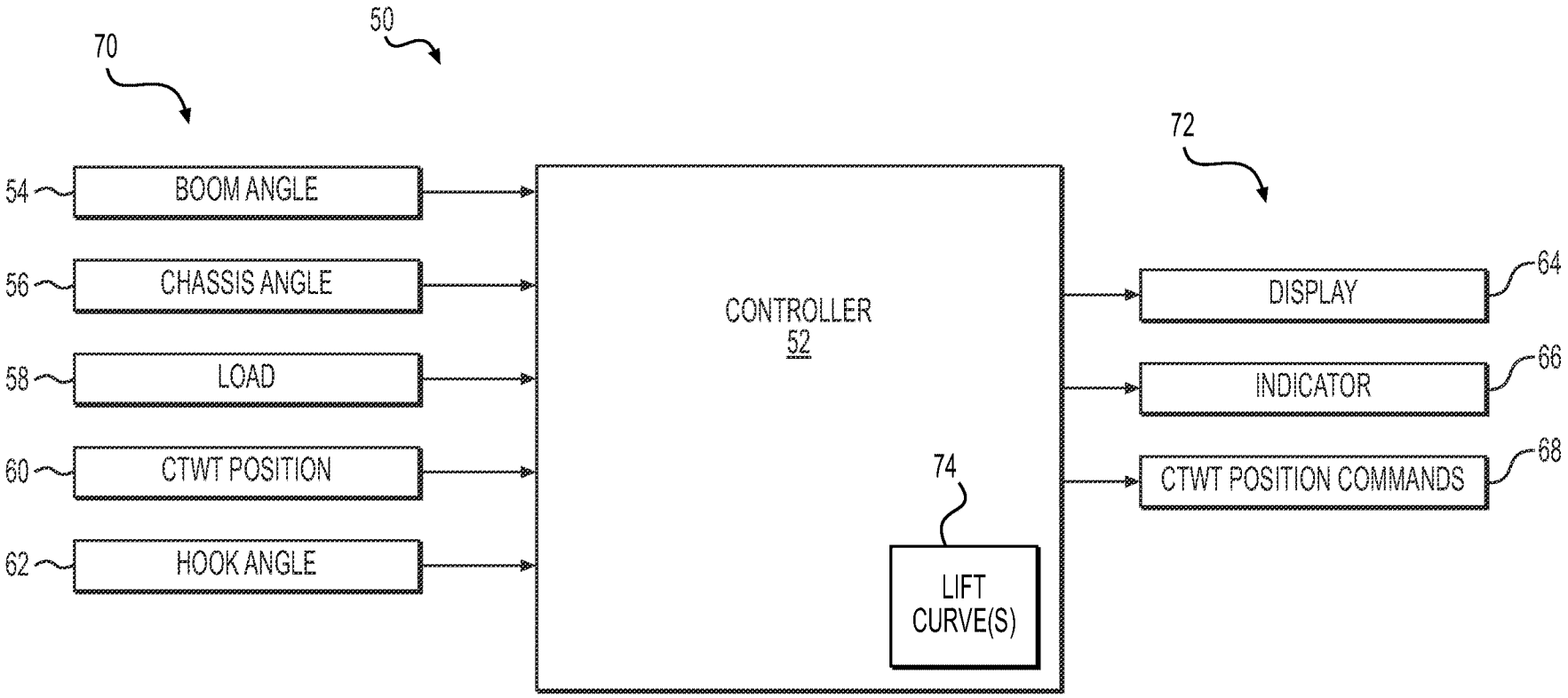
FIG. 6 shows an exemplary control system of the lifting machine of FIG. 1.

With reference to FIG. 6, control system 50 may include controller 52 having inputs 70 and outputs 72. Controller 52 may include any appropriate hardware, software, firmware, etc. to carry out the methods described in this disclosure, including the method of FIG. 7. Controller 52 may include one or more processors, memory, communication systems, and/or other appropriate hardware. The processors may be, for example, a single or multi-core processor, a digital signal processor, microcontroller, a general purpose central processing unit (CPU), and/or other conventional processor or processing/controlling circuit or controller. The memory may include, for example, read-only memory (ROM), random access memory (RAM), flash or other removable memory, or any other appropriate and conventional memory. The software of controller may be stored in the memory and may include mathematical equations, look-up tables, and/or maps, such as one or more lift curves 74, for determining values as discussed below. The communication systems used in the components of the control system 50 may include, for example, any conventional wired and/or wireless communication systems such as Ethernet, Bluetooth, and/or wireless local area network (WLAN) type systems. The communication system of controller 52 may include communication to and from controller 52, for example, to or from sensors 54-62, indicator 66, and display 64.

Inputs 70 to controller 52 may include inputs from sensors 54-62 providing data regarding the lift capacity of pipelayer machine 10. For example, sensor 54 may be a boom angle sensor to provide data corresponding to an angle of boom 22 with respect to chassis 12. Boom angle sensor 54 may be used by control system 50 to determine, or as a value indicative of, the distance of overhang of boom 22 away from chassis 12 of pipelayer machine 10. Boom angle sensor 54 may be located at boom tip 30, or at other appropriate positions on pipelayer machine 10. Sensor 56 may be a chassis angle sensor providing data corresponding to the fore or aft pitch and roll of the pipelayer machine 10. The chassis angle sensor 56 maybe located on the chassis 12, or at other appropriate positions on pipelayer machine 10. Sensor 58 may be a load sensor providing data regarding the load connected to grapple hook 40. Load sensor 58 may be located at pulley or sheave 38 of winch system 24, or at other appropriate positions on pipelayer machine 10. Sensors 60 may be associated with each counterweight assembly 102, 104 to provide data indicative of the location, position or extension of each counterweight assembly 102, 104. Counterweight position sensors 60 may be located on actuator 114, counterweight assemblies 102, 104, or at other appropriate positions on pipelayer machine 10. Sensor 62 may be a hook position sensor providing data regarding the angular location of the grapple hook 40. For example, hook angle sensor 62 may provide an angular position of grapple hook 40 with respect to a vertical reference line or "plumb line" position of grapple hook 40—corresponding to a position of grapple hook 40 and associated lifting cables 42 extending from pulley or sheave 44 extending vertically along the force of gravity. Grapple hook 40 may be skewed in the roll direction extending away from a side of pipelayer machine 10, or skewed in a pitch direction extending fore or aft with respect to a plumb line position from boom tip 30. Hook angle sensor 62 may be located on grapple hook 40, or at other appropriate positions on pipelayer machine 10. Sensors 54-62 may form a sensing system and may include any standard type of sensor, such as an inertial measurement unit (IMU) for the chassis angle sensor 56, an angle sensor for the boom angle and hook angle sensors 54, 62, a load pin type sensor for the load sensor 58, a linear position sensor or rotary sensor for the counterweight position sensor 60, a camera-based sensor, or any other appropriate type of sensor to provide the required data.

Outputs 72 from controller 52 may include, for example, information sent to display 64 and indicator 66, and counterweight position commands 68. Referring to FIGS. 1 and 6, display 64 may be any type of display, screen, information panel, etc. for receiving information from controller 52 and providing information to an operator or supervisor of pipelayer machine 10. Display 64 may be located in operator's cab 16, and/or be located at a remote location. As will be described in more detail below, display 64 may provide information relating to, for example, the lift capacity of pipelayer machine 10 received from control system 50. Indicator 66 may be any type of indicator for proving information to an operator of pipelayer machine 10, or personnel located near pipelayer machine 10. For example, as shown in FIG. 1, indicator 66 may be a series of indicator lights that provide visual lift capacity information, such as green, yellow, and red lights that provide a warning of a potential tipping of pipelayer machine based on exceeding a lifting limit as determined by control system 50. While indicator 66 is shown as a visual indicator on the operator's cab, it is understood that the indicator could be alternatively or additionally be an audible indicator, and could be located at any appropriate location on pipelayer machine 10. Counterweight position commands 68 may include commands from controller 52 to actuator 114 for controlling movement of actuator 114, and thus controlling the position of counterweight assemblies 102, 104.

INDUSTRIAL APPLICABILITY

The disclosed aspects of the present disclosure may be used in any pipelayer machine 10 that has the potential to tip based on dynamic loading. For example, the present disclosure may be used by a pipelayer machine 10 to provide an assist in avoiding forward—rearward tipping of the pipelayer machine 10 when the pipelayer machine 10 is located on a forward—rearward slope.

During operation of pipelayer machine 10, control system 50 monitors the lifting capacity of the pipelayer machine 10 based on data from sensors 54-62. Outputs of real-time lifting capacity status may be provided by controller 52 to display 64 and/or indicator 66. Counterweight position commands 68 may be automatically generated as a function of the lifting capacity status, and/or based on machine operator commands.

As noted above, controller 52 may include one or more maps, tables, charts, etc. that identify a lifting limit of the pipelayer machine 10 based on various sensed parameters, such as information from one or more of sensors 54-62. For example, controller 52 may include one or more lift curves 74 compiled or formed based on experimental, empirical, or calculated data and may be based on the physical attributes of pipelayer machine 10. Lift curve(s) 74 may provide a tipping load of the pipelayer machine 10 as a function of the sensed information from sensors 54-62, e.g. boom overhang distance (via boom angle sensor 54), fore, aft, and roll angle of chassis 12 (via chassis angle sensor 56), the load on the boom 22, for example, from a pipe 90 (via load sensor 58), the position of counterweight assemblies 102, 104 (counterweight position sensors 60), and the skew or angular position of grapple hook 40 (via hook angle sensor 62). The tipping load or tipping limit may corresponds to a load on boom 22 that will tip the pipelayer machine 10 in one or more of a forward, rearward (fore or aft), or roll direction. For example, lift curve(s) 74 may compare the sensed information to experimental, empirical, or calculated data on tipping load limits of pipelayer machine 10. Real-time lifting capacity status from lift curve(s) 74 and controller 52 may be provided on a real-time basis to display 64 and/or indicator 66.

As part of the real-time lifting capacity status determination in controller 52, the forward or rearward positions of counterweight assemblies 102, 104 are taken into account. Controller 52 may also function to actively control a forward or rearward movement of counterweight assemblies 102, 104 when the real-time lifting capacity status indicates that the pipelayer machine is approaching a forward or rearward (fore-aft) tipping point or tipping load limit. For example, controller 52 may issue one or more counterweight position commands 68 to actuate actuators 114 to move counterweight assemblies 102 and/or 104 in a forward or rearward direction to reduce the potential for fore-aft tipping. While controller 52 may provide for automatic positioning of the counterweight assemblies 102, 104, the positioning of the counterweight assemblies 102, 104 may additionally or alternatively be initiated by operator commands, such as through an operator interface. Such manually initiated movements of the counterweight assemblies 102, 104 may be derived by the operator to counteract potential tipping in a forward-rearward direction based on the forward-to-rearward slope of the pipelayer machine 10.

Figure 3:
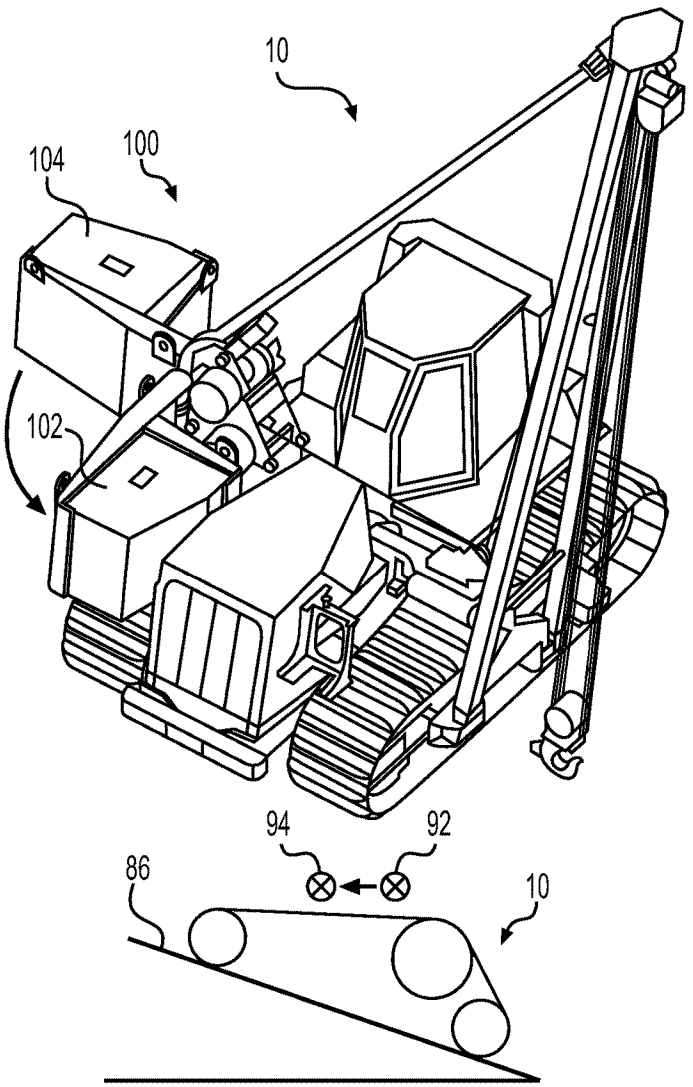
FIGS. 2-5 shows a perspective view of the lifting machine of FIG. 1 with the counterweight assemblies in various positions.
Figure 4:
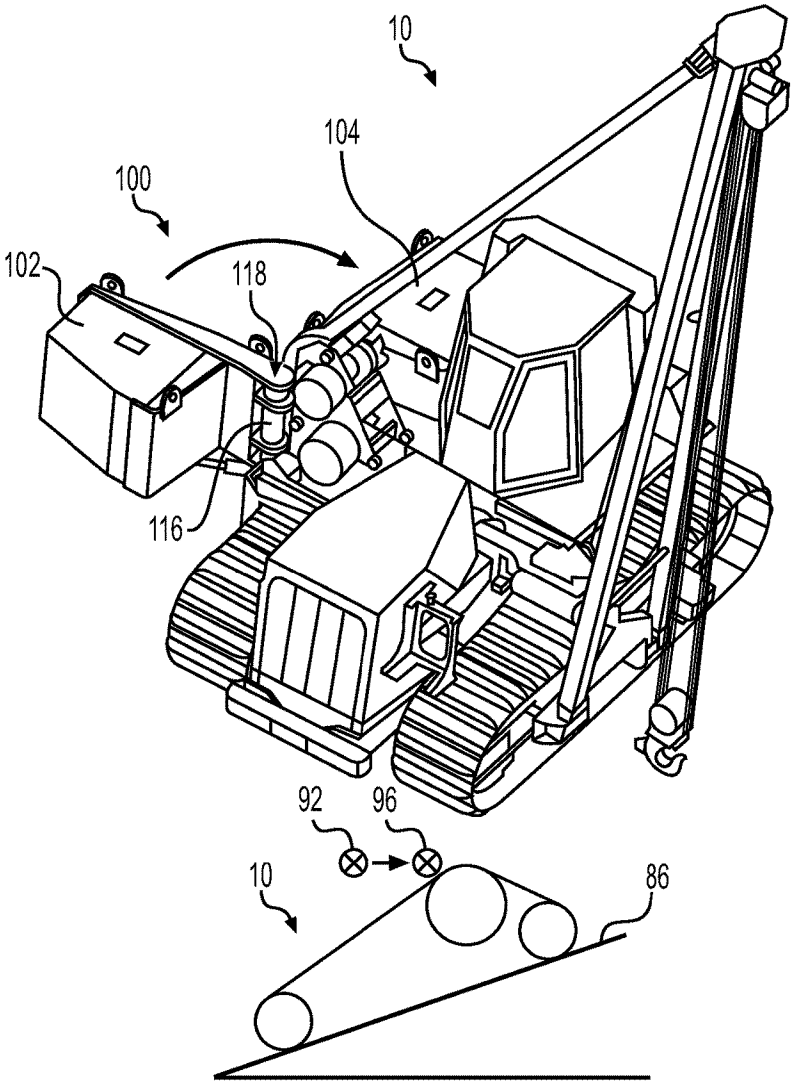

FIGS. 2-5 show different positions of counterweight assemblies based on the fore-aft slope of the pipelayer machine 10. For example, FIG. 2 depicts counterweight assemblies 102, 104 both in a fully extended position. Such a position may be appropriate when the pipelayer machine 10 is on flat ground 86. In such a situation, the pipelayer machine 10 may have a fore-aft center of gravity 92. When the pipelayer machine 10 is positioned upward on a slope of ground 86, as shown in FIG. 3, the forward counterweight 102, may be moved (automatically or manually) in a forward direction, such as to the fully retracted or stowed position shown FIG. 3. This movement serves to shift the fore-aft center of gravity 92 forward to 94, thereby increasing the lifting capacity of pipelayer machine 10 in the fore-aft direction. When the pipelayer machine 10 is positioned on a down slope of ground 86 as shown in FIG. 4, the rear counterweight assembly 104 may be moved (automatically or manually) in a rearward direction, such as to the fully retracted or stowed position shown in FIG. 4. This movement serves to shift the fore-aft center of gravity 92 rearward to 96, thereby increasing the lifting capacity of the pipelayer machine 10 in the fore-aft direction. While FIGS. 3 and 4 show movement of a counterweight assemblies 102, 104 to the fully retracted position, it is understood that the counterweight assemblies 102, 104 could be positioned at any intermediate position between the fully extended positions (FIG. 2) and the fully retracted positions (FIG. 5). For example, controller 52 may determine from lifting curve that both the fore-aft tipping capacity and roll tipping capacity should be increased by counterweight system 100. Accordingly, the counterweight assemblies 102, 104 may be moved partially forward or rearward to increase fore-aft tipping capacity, while also extending the counterweight assemblies 102, 104 away from the chassis 12 to increase the roll tipping capacity. Thus, while the positions of counterweight assemblies 102, 104 shown in FIGS. 2 and 5 have the same fore-aft center of gravity, the fully extended position of counterweight assemblies 102, 104 shown in FIG. 2 provides for increasing the roll tipping capacity of the pipelayer machine 10 by shifting the roll center of gravity away from the chassis 12.

Figure 7:
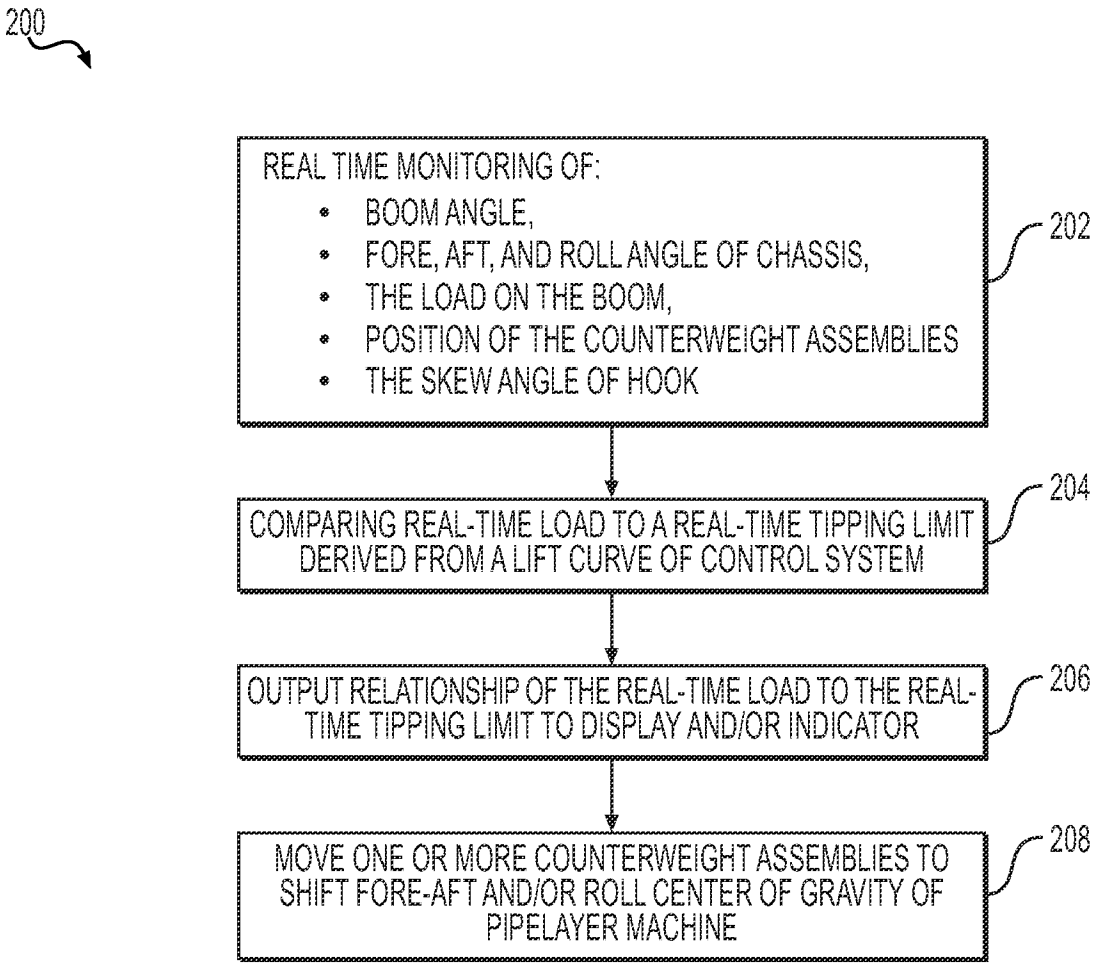
FIG. 7 is an exemplary method of operating the exemplary lifting machine of FIG. 1.

FIG. 7 provides a method 200 of operation of a pipelayer machine 10 in accordance with the present disclosure. Method 200 includes real-time monitoring of information from sensors 54-62, e.g. a boom overhang distance (via boom angle sensor 54), fore, aft, and roll angle of chassis 12 (via chassis angle sensor 56), the load on the boom 22, for example, from pipe 90 (via load sensor 58), the position of counterweight assemblies 102, 104 (via counterweight position sensors 60), and the skew or angular position of grapple hook 40 (via hook angle sensor 62) (step 202). The monitored information is provided to controller 52. The method further includes comparing the real-time load on the grapple hook 40 of the pipelayer machine 10 to a tipping load or limit derived from a lift curve(s) 74 of control system 50 as a function of the boom overhang distance (via boom angle sensor 54), fore, aft, and roll angle of chassis 12 (via chassis angle sensor 56), the load on the boom 22, (via load sensor 58), the position of counterweight assemblies 102, 104 (counterweight position sensors 60), and the skew or angular position of grapple hook 40 (via hook angle sensor 62) (step 204). In step 206, the relationship of the real-time load to the real-time tipping load or limit is output to an operator, supervisor, or other personnel via display 64 and/or indicator 66. The information provided to display 64 and/or indicator 66 may take different forms, such as an output of remaining lift capacity of the machine (as an absolute value, numerical comparison, or percentage of capacity remaining), or may take the form of a warning (visual and/or audible) when real-time loads approach the real-time tipping load. The method 200 may further include automatic or manual movement of one or more counterweight assemblies 102, 104 between the fully retracted and fully extended positions to increase the fore-aft tipping load or limit and/or the roll tipping load or limit (step 208). As explained above, the automatic movement may be carried out by counterweight position commands 68 sent from controller 52 to actuators 114, and may be triggered by the pipelayer machine 10 approaching a fore-aft tipping load or limit. Alternatively or additionally, the counterweight assemblies 102, 104 may be moved manually when the display 64 or indicator 66 give notice to the operator that the pipelayer machine 10 is approaching a tipping load or limit.

The counterweight system 100 of the present disclosure may facilitate a greater lifting capacity of the pipelayer machine 10 by providing the ability to manipulate the center of gravity of the pipelayer machine 10 in the fore-aft (forward-rearward) direction, therefore gaining a lift capacity advantage on slopes. Further, the selective and independent control of the counterweight assemblies 102, 104 provide a wide range of adjustments to the center of gravity of the pipelayer machine 10—in both the fore-aft direction and the roll direction. The ability of the counterweight assemblies 102, 104 to be positioned in a stowed position that does not increase the length, width, or height profile of lifting machine facilitates more efficient shipping of the pipelayer machine 10.

It will be apparent to those skilled in the art that various modifications and variations can be made to the disclosed system without departing from the scope of the disclosure. Other embodiments of the system will be apparent to those skilled in the art from consideration of the specification and practice of the counterweight system disclosed herein. It is intended that the specification and examples be considered as exemplary only, with a true scope of the disclosure being indicated by the following claims and their equivalents.

What is claimed is:

1. A mobile pipelayer machine, comprising:

a machine chassis having a forward end, a rear end, a first side, and a second side;

at least one sensor configured to measure a fore pitch or an aft pitch of the machine;

a boom extending from the first side of the machine chassis;

a movable counterweight system extending from the second side of the machine chassis, the movable counterweight system being selectively movable to change a center of gravity of the machine in at least one of a forward or a rearward direction; and a controller configured to control the movable counterweight system based on the measured fore pitch or the measured aft pitch.

2. The pipelayer machine of claim 1, wherein the counterweight system includes at least one counterweight assembly selectively movable in the forward or the rearward direction.

3. The pipelayer machine of claim 2, wherein the controller is configured to automatically move the at least one counterweight assembly based on a forward-to-rearward slope of machine reflected in the measured fore pitch or the measured aft pitch.

4. The pipelayer machine of claim 3, wherein the automatic movement is further based on a load coupled to the boom.

5. The pipelayer machine of claim 2, wherein the at least one counterweight assembly is pivotably connected to the second side of the machine chassis for movement about a horizontal plane.

6. The pipelayer machine of claim 5, wherein the at least one counterweight assembly includes a pair of counterweight assemblies.

7. The pipelayer machine of claim 6, wherein the pair of counterweight assemblies are each pivotable through a range of approximately 90 degrees.

8. The pipelayer machine of claim 6, wherein the pair of counterweight assemblies are independently movable.

9. The pipelayer machine of claim 6, wherein the pair of counterweight assemblies are movable to a stowed position where the counterweight assemblies do not increase a width profile of the pipelayer machine.

10. The pipelayer machine of claim 2, wherein the at least one counterweight assembly is movable to a stowed position over a track of the pipelayer machine.

11. The pipelayer machine of claim 10, wherein the at least one counterweight assembly does not increase a width profile of the pipelayer machine.

12. A mobile pipelayer machine, comprising:

a machine chassis having a forward end, a rear end, a first side, and a second side;

a boom extending from the first side of the machine chassis; and a movable counterweight system extending from the second side of the machine chassis, the movable counterweight system being selectively movable in response to commands from a controller forwardly, rearwardly, and laterally towards and away from the second side of the machine chassis to change a center of gravity of the machine in a forward, rearward, and roll direction based on information from a sensor indicating forward-rearward slope of the machine, the movable counterweight system including a first counterweight assembly and a second counterweight assembly that are independently movable between a plurality of positional arrangements, including:

a first positional arrangement in which the first counterweight assembly is in a first position and the second counterweight assembly is in a second position; and a second positional arrangement in which the first counterweight assembly is in a third position, the second counterweight assembly is in the second position, and the center of gravity of the machine is spaced apart, along the forward direction or the rearward direction, from the center of gravity of the machine in the first positional arrangement.

13. The pipelayer machine of claim 12, wherein the first counterweight assembly and the second counterweight assembly are pivotably connected to the second side of the machine chassis for movement about a horizontal plane.

14. The pipelayer machine of claim 12, wherein the first counterweight assembly and the second counterweight assembly are each pivotable through a range of approximately 90 degrees.

15. The pipelayer machine of claim 12, wherein the first counterweight assembly and the second counterweight assembly are movable to a stowed position where the first counterweight assembly and the second counterweight assembly do not increase a width profile of the pipelayer machine.

16. The pipelayer machine of claim 12, wherein the first counterweight assembly and the second counterweight assembly are movable to a stowed position over a track of the pipelayer machine.

17. A method for adjusting a center of gravity of a pipelayer machine, the pipelayer machine including a controller, a chassis, a boom extending from the chassis, and a connector extending from the boom for coupling to a load, the method comprising:

determining, by the controller, a status of the pipelayer machine; and selectively moving, based on the status, a counterweight assembly in a forward or a rearward direction to change a forward or rearward center of gravity of the pipelayer machine.

18. The method of claim 17, wherein the moving of the counterweight assembly includes selectively moving a plurality of counterweight assemblies.

19. The method of claim 18, wherein the moving of the plurality of counterweight assemblies includes independently moving the plurality of counterweight assemblies.

20. The method of claim 17, further comprising sensing a fore pitch or an aft pitch, wherein the moving of the counterweight assembly is based on the sensed fore pitch or the sensed aft pitch.

* * * * *